US011891872B1

(12) United States Patent
Allen

(10) Patent No.: US 11,891,872 B1
(45) Date of Patent: Feb. 6, 2024

(54) WELLHEAD CONNECTOR ASSEMBLY WITH REPLACEABLE SEALING MEMBER

(71) Applicant: Universal Wellhead Services Holdings, LLC, Corpus Christi, TX (US)

(72) Inventor: Jack R. Allen, Porter, TX (US)

(73) Assignee: Universal Wellhead Services Holdings, LLC, Corpus Christi, TX (US)

( * ) Notice: Subject to any disclaimer, the term of this patent is extended or adjusted under 35 U.S.C. 154(b) by 0 days.

(21) Appl. No.: 18/176,744

(22) Filed: Mar. 1, 2023

Related U.S. Application Data

(63) Continuation of application No. 17/570,074, filed on Jan. 6, 2022, now Pat. No. 11,608,701.

(60) Provisional application No. 63/134,736, filed on Jan. 7, 2021.

(51) Int. Cl.
*E21B 33/06* (2006.01)
*E21B 17/02* (2006.01)

(52) U.S. Cl.
CPC ..... *E21B 33/06* (2013.01); *E21B 17/02* (2013.01)

(58) Field of Classification Search
CPC ..... E21B 33/038; E21B 17/02
See application file for complete search history.

(56) References Cited

U.S. PATENT DOCUMENTS 2,610,689 A * 9/1952 Eckel ..... E21B 33/04 285/356
3,220,245 A * 11/1965 Van Winkle ..... E21B 33/038 285/364
3,228,715 A * 1/1966 Neilon ..... E21B 33/038 285/317
3,288,472 A * 11/1966 Watkins ..... F16J 15/0887 277/626
3,321,217 A * 5/1967 Ahlstone ..... E21B 33/038 285/379
3,345,087 A * 10/1967 Hanes ..... F16L 25/02 285/321
3,482,410 A * 12/1969 Gentry ..... F16L 37/48 166/347
4,153,278 A * 5/1979 Ahlstone ..... F16L 37/002 285/263
4,239,266 A * 12/1980 Mynhier ..... F16L 21/007 285/348
4,708,376 A * 11/1987 Jennings ..... E21B 43/013 285/920
5,282,655 A * 2/1994 Marietta ..... F16L 23/04 285/330
5,299,644 A * 4/1994 Eckert ..... E21B 33/03 285/23
5,342,066 A * 8/1994 Henley ..... F16J 15/128 166/208

(Continued)

*Primary Examiner* — Aaron L Lembo
(74) *Attorney, Agent, or Firm* — Ted M. Anthony

(57) ABSTRACT

A connector assembly that selectively connects to a wellhead housing having a clamp type hub. The connector assembly utilizes a selectively energized clamp type connector and an internal replaceable seal assembly; the connector has clamp segments that selectively engage and secure against the clamp hub of the wellhead housing. As the connector assembly engages the wellhead housing, the internal replaceable seal member engages with the wellhead hub (and typically a seal ring thereof) to form a fluid pressure seal.

16 Claims, 10 Drawing Sheets

(56) References Cited

U.S. PATENT DOCUMENTS

| | | | | | |
|---|---|---|---|---|---|
| 5,725,056 | A * | 3/1998 | Thomson | E21B 33/03 | 166/208 |
| 5,799,730 | A * | 9/1998 | Lam | E21B 33/0422 | 166/75.14 |
| 6,367,558 | B1 * | 4/2002 | Borak, Jr. | E21B 33/04 | 166/387 |
| 6,516,831 | B1 * | 2/2003 | Smith, III | E21B 17/02 | 137/614.04 |
| 8,602,458 | B2 * | 12/2013 | Rodgers | E21B 17/02 | 285/104 |
| 9,260,931 | B2 * | 2/2016 | Curtiss, III | E21B 17/06 | |
| 2021/0095535 | A1 * | 4/2021 | Cheng | E21B 33/04 | |
| 2022/0065065 | A1 * | 3/2022 | Lowry | E21B 33/06 | |

* cited by examiner

WELLHEAD CONNECTOR ASSEMBLY WITH REPLACEABLE SEALING MEMBER

CROSS REFERENCES TO RELATED APPLICATION

This application is a continuation of U.S. non-provisional patent application Ser. No. 17/570,074, filed Jan. 6, 2022, currently pending, which claims priority of U.S. provisional patent application Ser. No. 63/134,736, filed Jan. 7, 2021, all incorporated herein by reference.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a wellhead connector. More particularly, the present invention pertains to a clamp-type wellhead connector having a separate internal seal member that is selectively removeable and replaceable. More particularly still, the present invention pertains to a clamp-type wellhead connector that facilitates rapid and cost effective repair of damaged wellhead seal grooves, either in the field or at a remote repair facility.

2. Description of Related Art

Connector assemblies are frequently employed to attach various different types of equipment to wellhead housings. For example, connectors are frequently utilized to attach a blowout preventer ("BOP") assembly or a production "Christmas tree" (typically a plurality of valves and connectors) to a wellhead assembly of a well. Typically, conventional flanged connections are commonly utilized for this purpose; such flanged connections involve the use of a plurality of threaded bolts and nuts to secure opposing flange members together. Threading and/or unthreading of such multiple bolts and nuts on such conventional flange connectors can be extremely labor-intensive, time-consuming and expensive, and can give rise to significant safety concerns due to the amount and type of labor required.

Conventional connector devices have been developed for use in lieu of multiple threaded bolts and nuts; such conventional connector devices can be much less labor intensive than the use of threaded nuts and bolts. As a result, such conventional connectors can significantly reduce the amount of time and labor required to install and/or uninstall said connectors. Additionally, such clamp-type connectors are typically safer than connecting wellhead components using multiple threaded nuts and bolts.

Such conventional connector devices commonly include at least one (typically internal) seal groove for receiving a seal member used to form a fluid pressure seal between components (such as the connector device and the underlying wellhead). However, such seal grooves are susceptible to damage during normal use. For example, said seal grooves can be inadvertently damaged during the installation process, such as when a connector is maneuvered or positioned over a wellhead.

In the event of such damage, the connector device must be removed from the wellhead, and the seal groove(s) must be repaired, typically by machining said seal groove(s) to remove gouges or other imperfections. Such repairs can be expensive and time consuming. In many cases, the damaged connector (or at least certain components thereof) must be shipped from a well site to a distant machine shop or other facility where such repairs can be made, further adding to the time and expense associated with said repair. Moreover, ongoing operations may need to be interrupted or shut down for extended periods, potentially resulting in additional expense and safety concerns.

Thus, there is a need for an improved wellhead connector, such as a clam p-type wellhead connector, having a separate internal replaceable seal member. The clamp-type wellhead connector should facilitate rapid and inexpensive repair of damaged wellhead seal grooves, especially in the field (including, without limitation, at a remote well site).

SUMMARY OF THE INVENTION

The present invention comprises a wellhead connector assembly that permits attachment or connection of various different types of equipment to conventional wellhead housings. By way of illustration, but not limitation, the wellhead connector assembly of the present invention can serve as an interface to operationally attach a BOP assembly or Christmas tree to a conventional wellhead installed on a wellbore.

In a preferred embodiment, said wellhead connector assembly comprises an outer housing and clamp-type hub, as well as an internally replaceable seal member. Said clamp-type hub further comprises a plurality of radially movable clamp wedge segments that can selectively engage against a clamp hub of a conventional wellhead housing; a plurality of actuation screws can be used to move said clamp segments from an unlocked to a locked position by moving the clamp segments radially inward into locking engagement against said wellhead housing. More specifically, said plurality of actuation screws, when rotated, can selectively move said clamp segments radially inward into engagement against a clamp hub of said wellhead housing, thereby securing said outer housing to said wellhead.

As the connector assembly engages against a wellhead housing, said internal replaceable seal member (having mating seal grooves between the replaceable seal member, the connector body and the wellhead housing) compresses a separate sealing element and forms a fluid pressure seal between the replaceable seal member and the connector housing. In the event of inadvertent damage, said internally replaceable seal member can be inexpensively and rapidly repaired or replaced, thus facilitating repair of damaged seal grooves, especially in the field (including, without limitation, at remote well sites).

BRIEF DESCRIPTION OF DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures. Various features, aspects, and advantages of the present invention will become better understood when the following detailed description is read with reference to the accompanying figures in which like characters represent like parts throughout the figures, wherein:

DETAILED DESCRIPTION OF THE PREFERRED EMBODIMENT

Referring to the figures, wherein like numerals indicate like or corresponding components throughout the several views, a preferred embodiment is shown and depicted. For purposes of illustration and not to be limiting in any way, the following description references a wellhead connector assembly of the present invention including, without limitation, replaceable seal member, connector seal, wellhead seal and wellhead housing.

Figure 1:
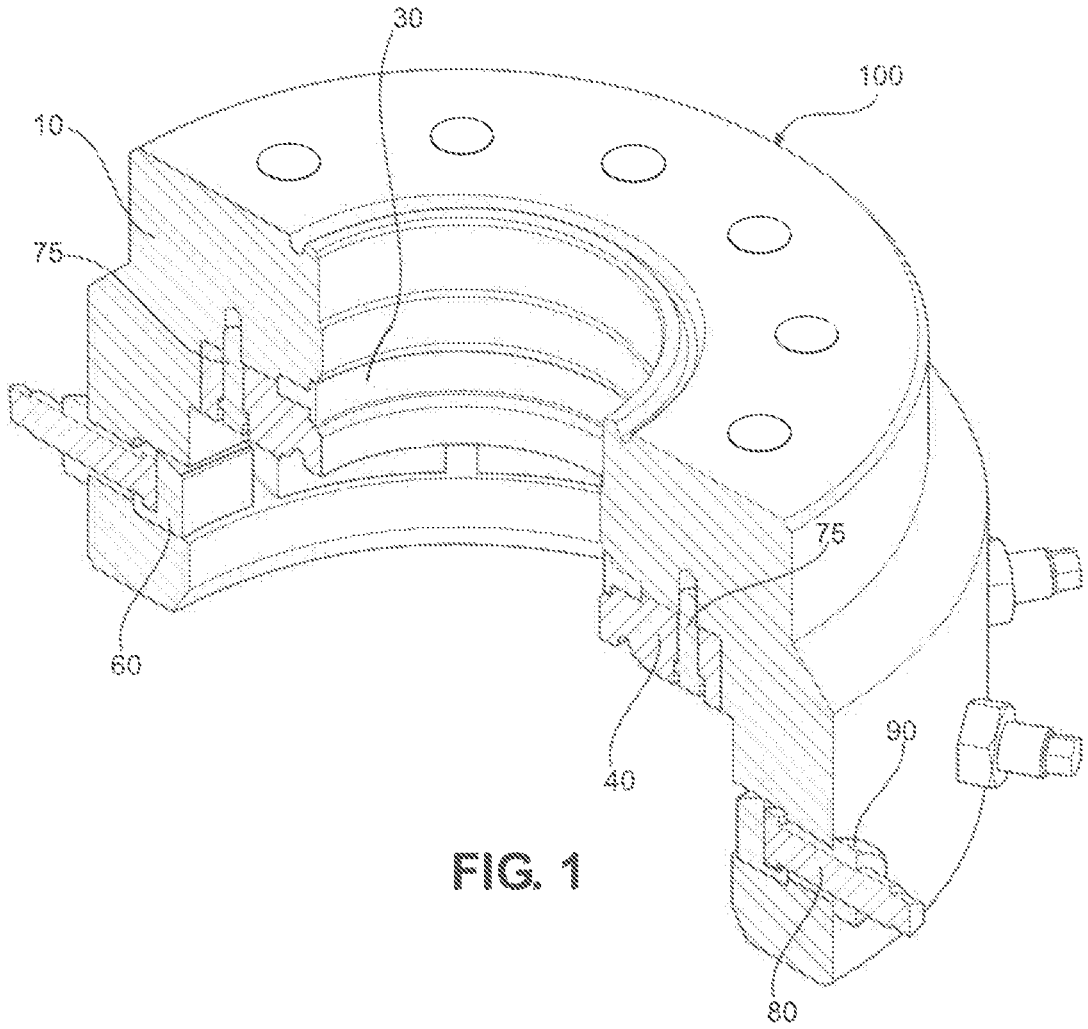
FIG. 1 depicts a side perspective view of a portion of a wellhead connector assembly of the present invention.

FIG. 1 depicts a side perspective view of a portion of a wellhead connector assembly 100 of the present invention. Although said wellhead connector assembly 100 is depicted in FIG. 1 as being substantially semi-circular in shape, it is to be understood that FIG. 1 also represents a sectional view; in a preferred embodiment said wellhead assembly 100 is substantially circular in shape when not viewed in sectional depiction. As such, the view depicted in FIG. 1 is a perspective and partial sectional view illustrating one half of said wellhead connector assembly 100 of the present invention, as well as certain internal components thereof. Still referring to FIG. 1, said wellhead connector assembly 100 generally comprises connector body member 10, first seal member 30, replaceable seal member 40, clamp assembly 60, actuating screw gland nuts 90, actuating screws 80 and mechanical fasteners 75.

Figure 2:
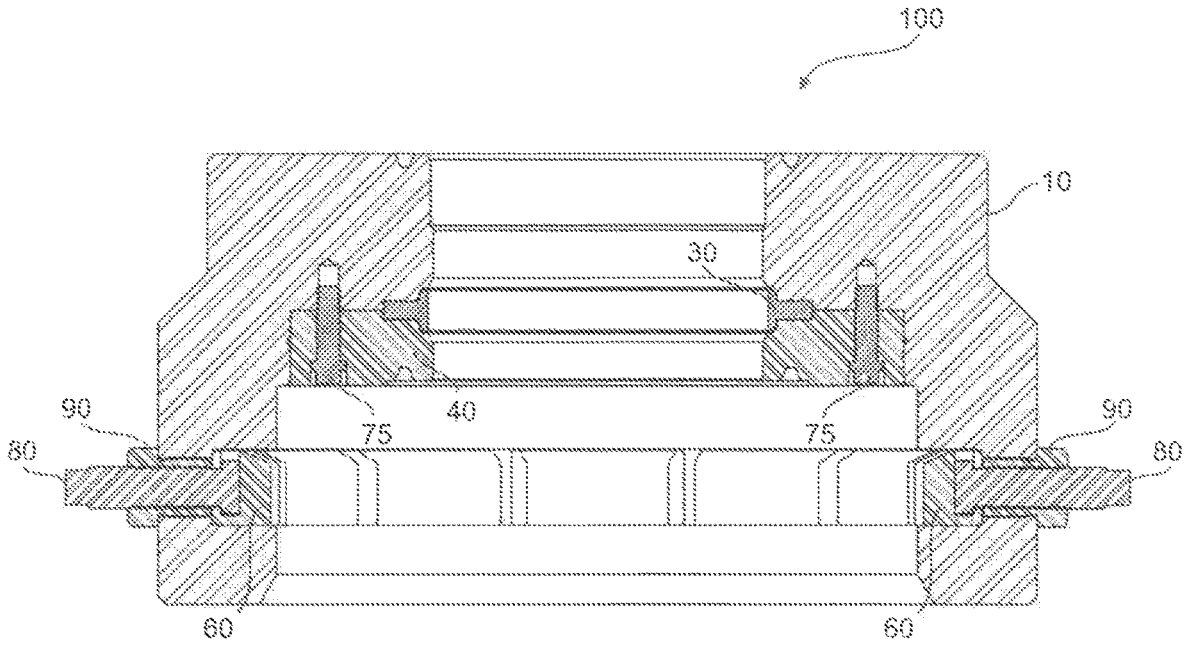
FIG. 2 depicts a side sectional view of a wellhead connector assembly of the present invention, including an internal replaceable seal member.

FIG. 2 depicts a side sectional view of a wellhead connector assembly 100 of the present invention, including an internal replaceable seal member 40. In a preferred embodiment, said wellhead connector assembly 100 generally comprises connector body member 10 having a central through bore, first seal member 30, replaceable seal member 40, clamp assembly 60, actuating screw gland nuts 90, actuating screws 80 and mechanical fasteners 75.

Figure 3:
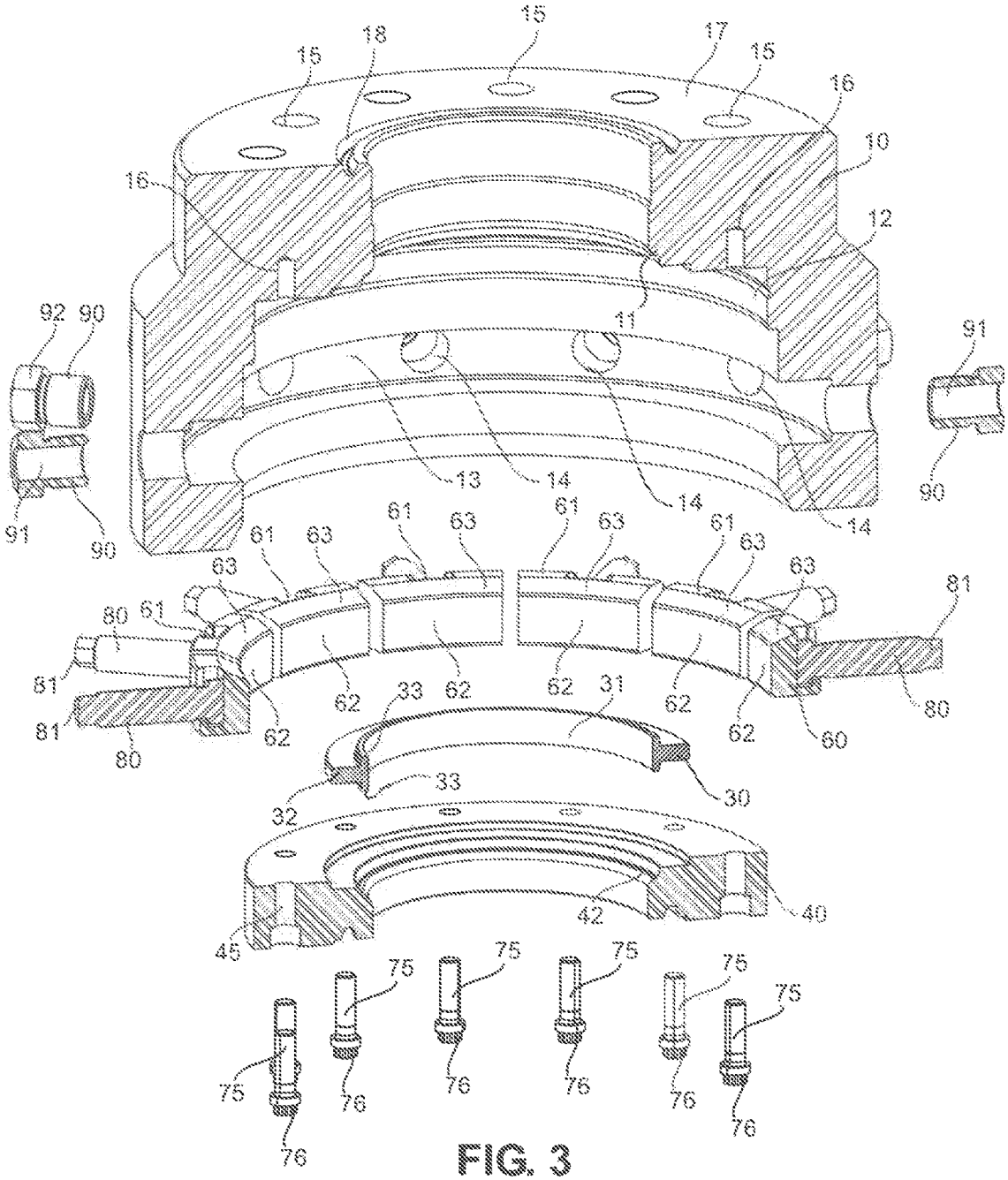
FIG. 3 depicts an exploded perspective view of a wellhead connector assembly of the present invention.

FIG. 3 depicts an exploded perspective view of wellhead connector assembly 100 of the present invention. As with FIG. 1, although said wellhead connector assembly 100 is depicted in FIG. 3 as being substantially semi-circular in shape, it is to be understood that in a preferred embodiment said wellhead assembly 100 is substantially circular in shape. As such, the view depicted in FIG. 3 is a perspective and partial sectional view illustrating one half of said wellhead connector assembly 100 of the present invention.

In a preferred embodiment, body member 10 generally comprises a housing or body segment defining first internal seal groove 11, a substantially circular inner through bore 12, as well as internal clamp groove 13; said first internal seal groove 11 and clamp groove 13 are generally oriented substantially parallel to each other and disposed along the inner surface of inner through bore 12. A plurality of transverse bores 14 extend from the outer surface of said connector body 10 through said body into said clamp groove 13 and are disposed in spaced relationship around said connector body 10.

A plurality of upper bores 15—which can contain inner threads—are disposed within said connector body 10 around an upper surface 17 of connector body 10. A seal groove 18, typically disposed around through bore 12, can be disposed on said upper surface 17 and is configured to receive a conventional seal ring. Said upper bores 15 are generally disposed in spaced relationship and are oriented substantially perpendicular to said first internal seal groove 11 and said clamp groove 13. Said upper bores 15 can receive threaded bolts or studs (not pictured) to operationally attach a separate component, such as a BOP assembly, Christmas tree or other apparatus to said wellhead connection assembly 100, typically using a flange connection. Internal seal fastener bores 16 are disposed within connector body 10 and oriented are substantially perpendicular to said first internal seal groove 11 and said clamp groove 13, and substantially parallel to said upper bores 15.

A plurality of actuating screw gland nuts 90 are disposed within lateral transverse bores 14. In a preferred embodiment, said actuating screw gland nuts 90 have a central through bore 91, as well as head segment 92. Said head segment 92 can have a larger diameter than the portion of said actuating screw gland nuts 90 received within said transverse bores 14, as well as a shaped profile (e.g. hexagon) for mating engagement with a wrench or other tool.

Clamp assembly 60 is generally disposed within clamp groove 13 of connector body 10. Said clamp assembly generally comprises a plurality of arcuate, wedge-shaped clamp segments 61. In a preferred embodiment, each of said clamp segments 61 generally comprise a radially inwardly facing surface 62, as well as a tapered upper surface 63. At least one actuating screw 80, each having a shaped profile (e.g. hexagonal) 81 for mating with a wrench or other tool, is operationally attached to a wedge shaped clamp segment 61 of clamp assembly 60. It is to be observed that actuating screws 80 are received within bore 91 of actuation screw gland nuts 90.

First seal member 30 has a generally semi-circular shape and comprises inner circular seal member 31 defining seal surfaces 33, as well as outer flange member 32. Said first seal member 30 is received within first seal groove 11 of body member 10, while replaceable seal member 40 is received within circular bore 12 of body member 10. Mechanical fasteners 75, each having a shaped profile (e.g. hexagon) 76 for engaging with a wrench or other tool, are received within internal seal fastener bores 16.

Figure 4:
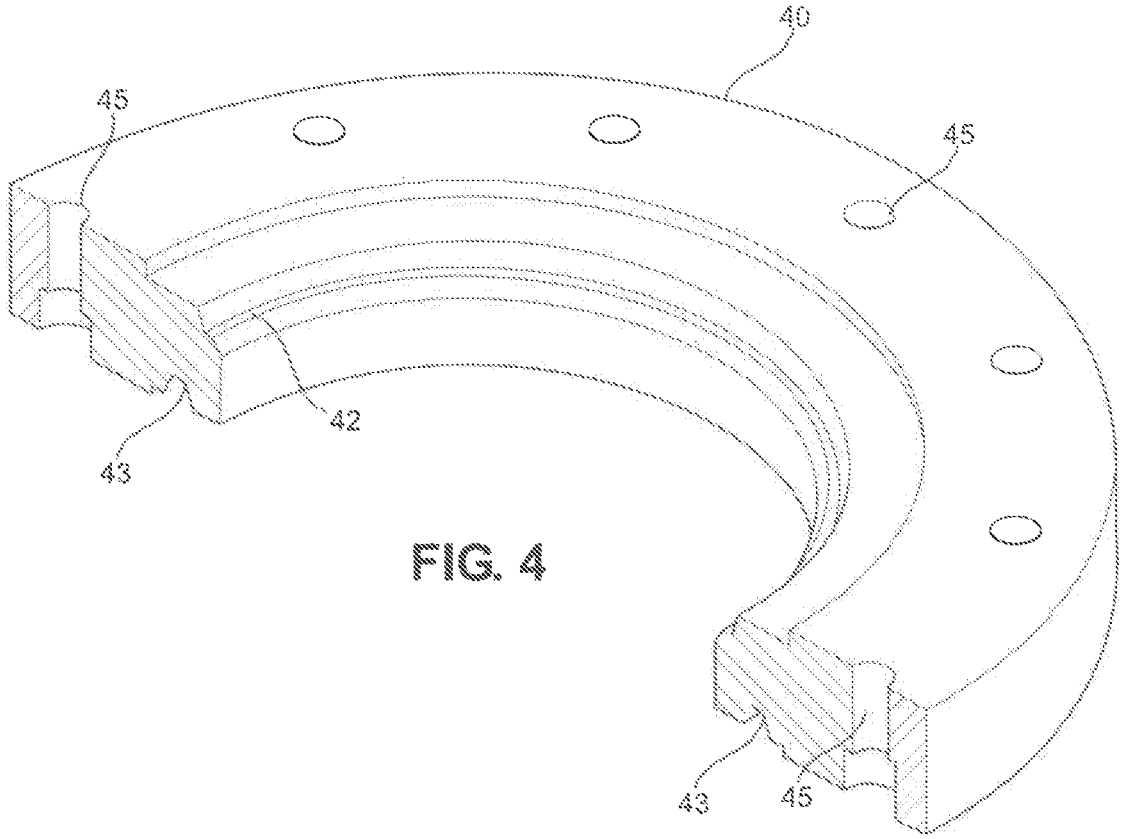
FIG. 4 depicts a side perspective view of a portion of an internal replaceable seal member of the wellhead assembly of the present invention.

FIG. 4 depicts a side perspective and sectional view of internal replaceable seal member 40 of a wellhead connector assembly 100 of the present invention. Although FIG. 4 depicts a sectional view of a portion of internal replaceable seal member 40, it is to be observed that said internal replaceable seal member 40 comprises a substantially circular ring. In a preferred embodiment, said seal member is at least partially constructed of elastomeric or rubber sealing material and comprises wellhead seal groove 43 for receiving a seal ring of a conventional wellhead assembly. Replaceable seal member 40 further comprises internal seal fastener bores 45 which, when said replaceable seal member 40 is installed, are linearly aligned with internal seal fastener bores 16 of connector body 10 (depicted in FIG. 3).

Figure 5:
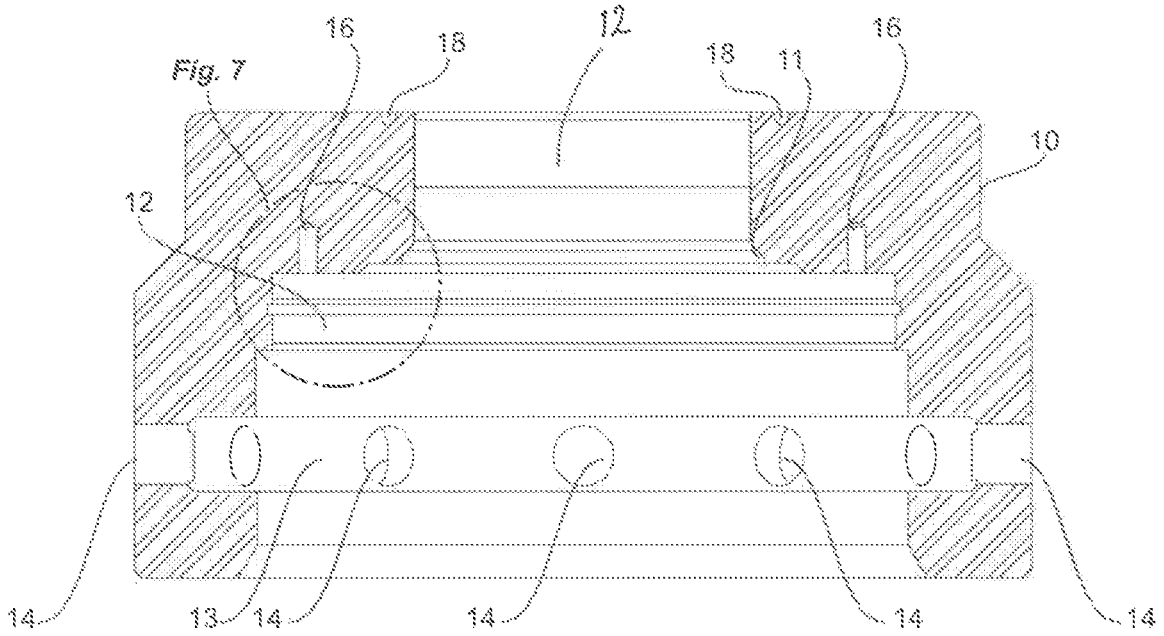
FIG. 5 depicts a side sectional view of a body member of the wellhead connector assembly of the present invention.

FIG. 5 depicts a side sectional view of a wellhead connector body member 10 of a wellhead connector assembly 100 of the present invention. Said body member 10 generally comprises a housing or body segment defining first internal seal groove 11, circular inner through bore 12, and internal clamp groove 13. First internal seal groove 11 and internal clamp groove 13 are generally oriented substantially parallel to each other. A plurality of transverse bores 14 extend through said body member 10 into said clamp groove 13, disposed in spaced relationship around said connector body 10. Internal seal fastener bores 16 are disposed within connector body 10; the longitudinal axes of said internal seal fastener bores are oriented substantially parallel to each other, and substantially perpendicular to the longitudinal axes of said first internal seal groove 11 and clamp groove 13.

Figure 6:
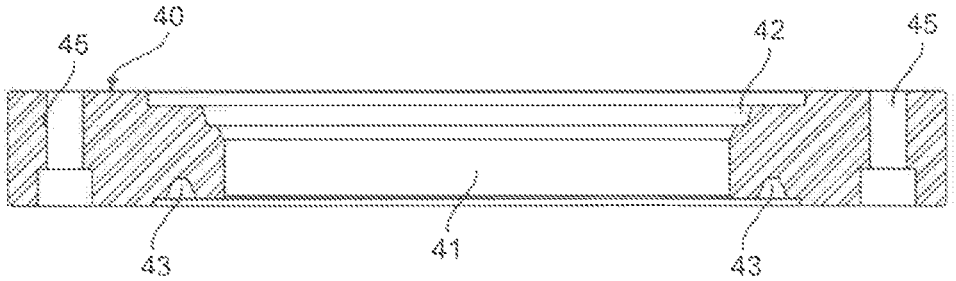
FIG. 6 depicts a sectional view of an internal replaceable seal member of a wellhead connector assembly of the present invention.

FIG. 6 depicts a side sectional view of internal replaceable seal member 40 of a wellhead connector assembly 100 of the present invention. As depicted in FIG. 6, internal replaceable seal member 40 comprises a substantially circular ring. In a preferred embodiment, said seal member 40 further comprises a ring at least partially constructed of elastomeric or rubber sealing material having central through bore 41; said central through bore 41 defines seal member groove 42, which is configured to accept first seal member 30. Said replaceable seal member 40 further comprises wellhead seal groove 43 for receiving a seal ring of a conventional wellhead assembly. Replaceable seal member 40 further comprises internal seal fastener bores 45 which, when said replaceable seal member 40 is installed, are linearly aligned with internal seal fastener bores 16 of connector body 10 (depicted in FIG. 3).

Figure 7:
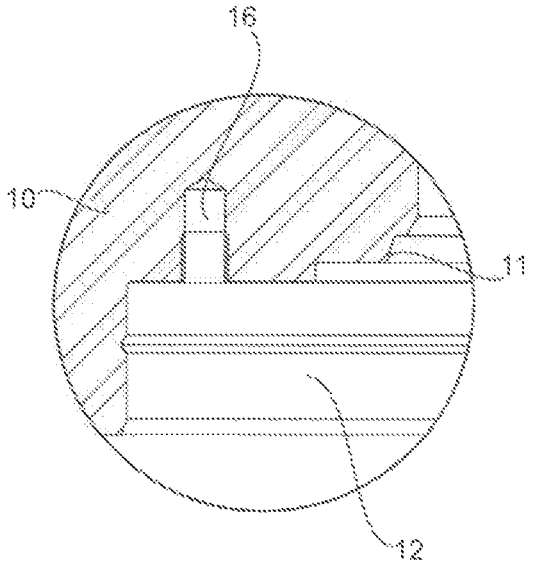
FIG. 7 depicts a detailed view of the highlighted portion of the wellhead body depicted in FIG. 5.

FIG. 7 depicts an enlarged side sectional view of a portion of wellhead connector body 10 of the wellhead connector assembly 100 of the present invention highlighted in FIG. 5. In a preferred embodiment, body member 10 generally comprises a housing or body segment defining inner through bore 12, first internal seal groove 11 and internal seal fastener bore 16.

Figure 8:
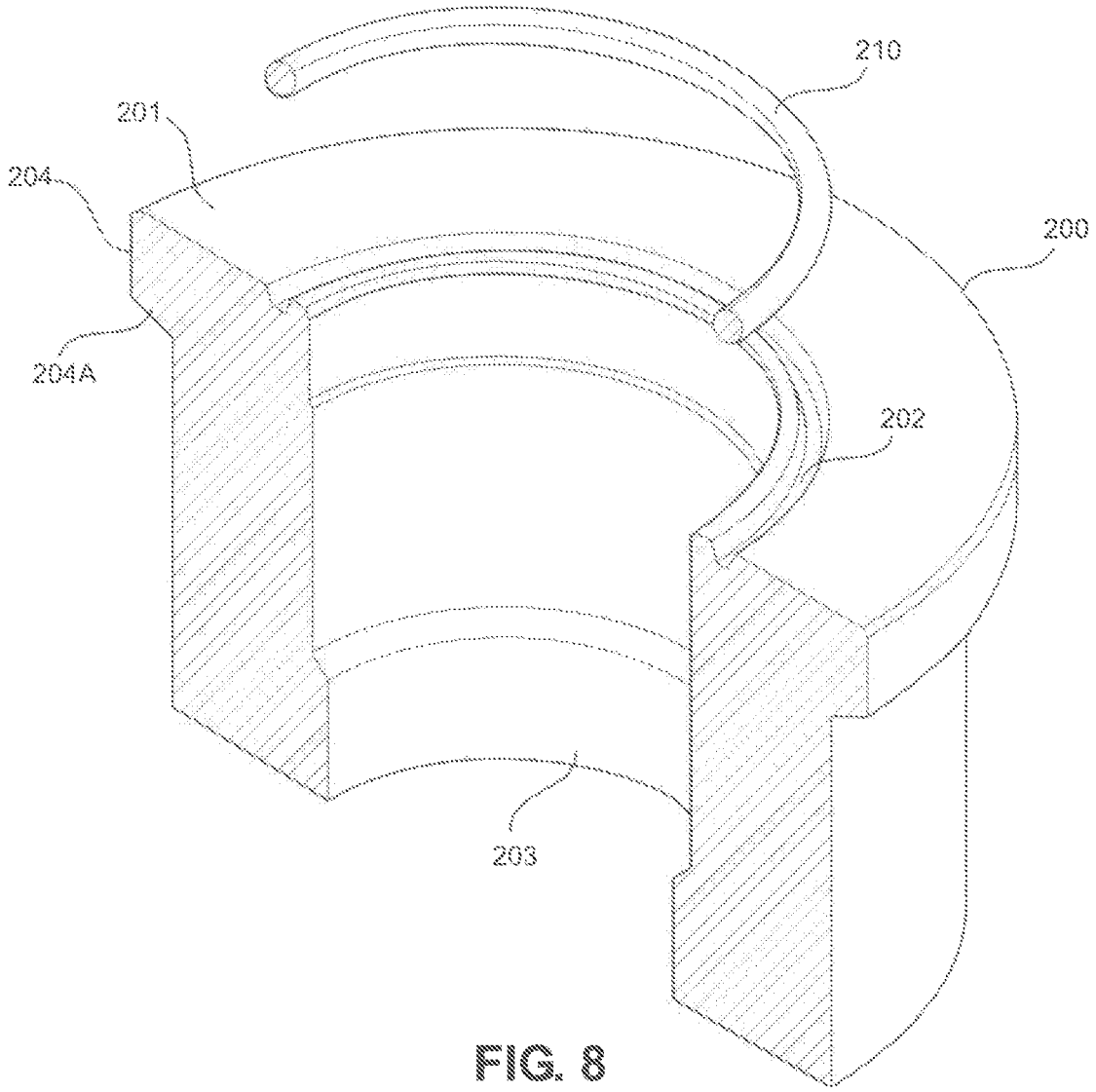
FIG. 8 depicts a side perspective view of a portion of a conventional wellhead hub and seal ring.
Figure 9:
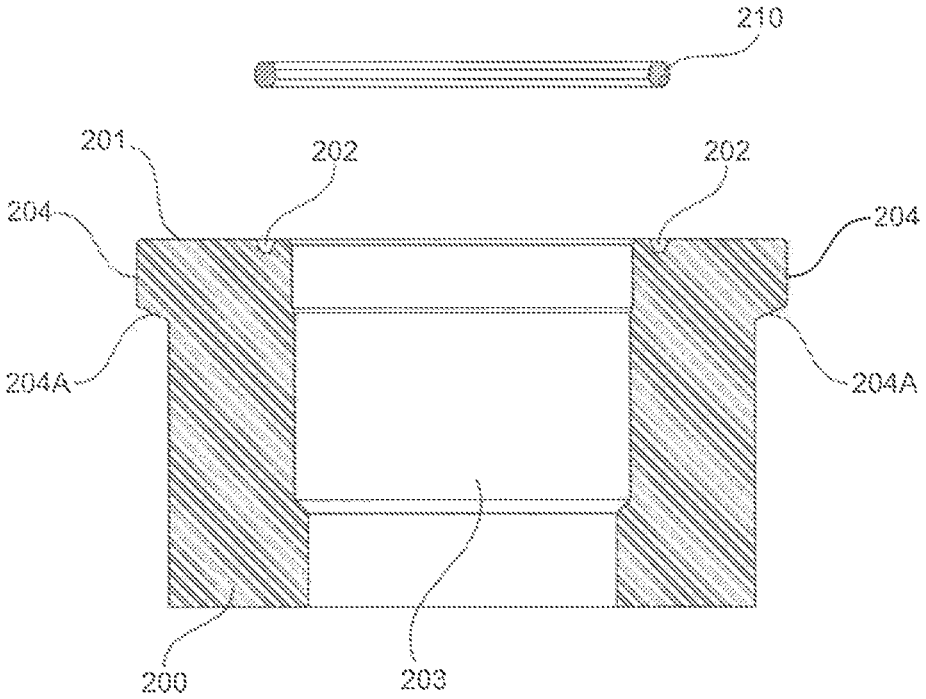
FIG. 9 depicts a side sectional view of a portion of a conventional wellhead hub and seal ring.

FIG. 8 depicts an exploded perspective view of a portion of a conventional wellhead hub 200 and wellhead seal ring 210, while FIG. 9 depicts an exploded side sectional view of said wellhead hub 200 and seal ring 210. It is to be observed that conventional wellhead hub 200 can have any number of different sizes, shapes and/or basic configurations without departing from the scope of the present invention. However, as depicted in FIGS. 8 and 9, conventional wellhead hub 200 has central through bore 203 and wellhead housing clamp hub 204 that defines upper surface 201. Seal bore 202 is disposed on said upper surface 201. In the configuration depicted in FIGS. 8 and 9, wellhead housing clamp hub 204 further defines lower tapered shoulder surface 204A. It is to be observed that wellhead hub 200 is typically disposed at the upper end of a wellbore and represents a connection hub or interface for connection of additional equipment on said wellbore (such as, for example, a BOP assembly or Christmas tree) using wellhead connector assembly 100 of the present invention.

Figure 10:
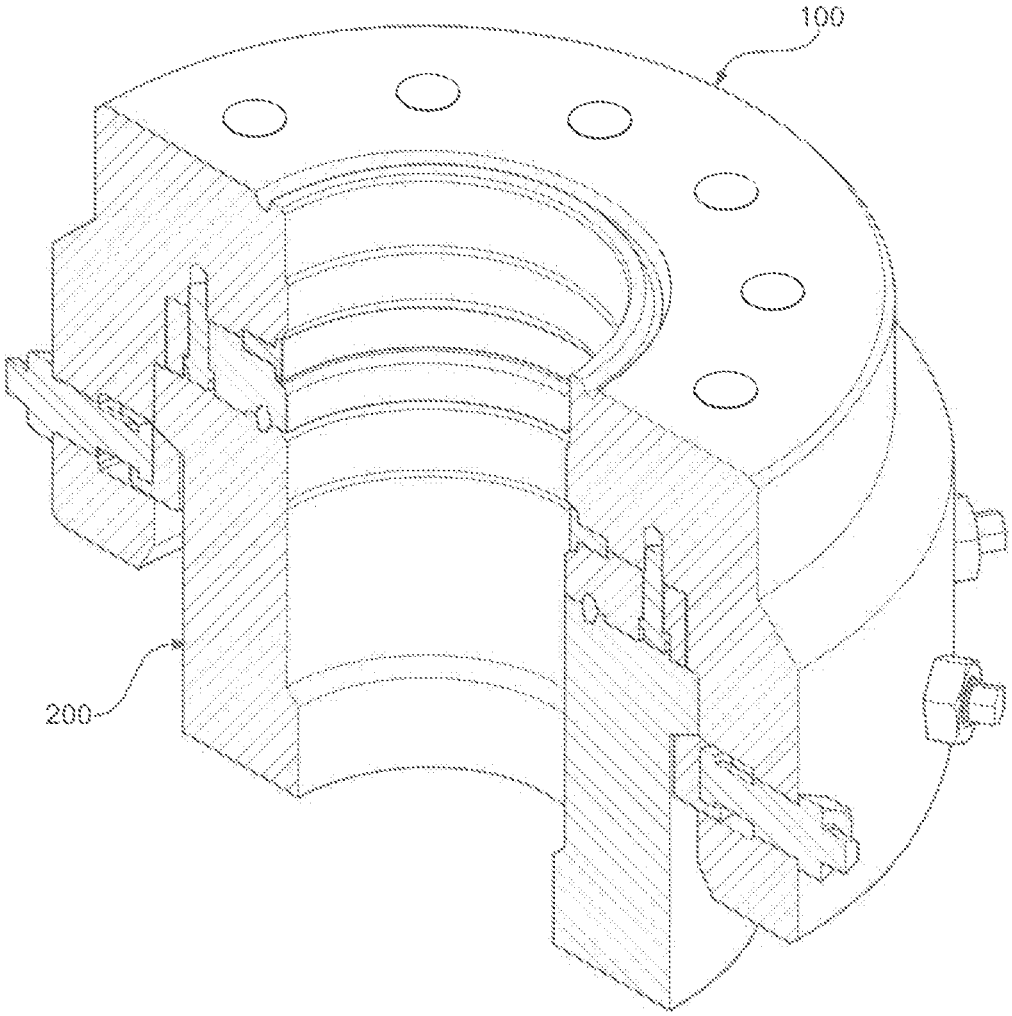
FIG. 10 depicts a side perspective and sectional view of a portion of a wellhead connector assembly of the present invention installed on a wellhead hub.
Figure 11:
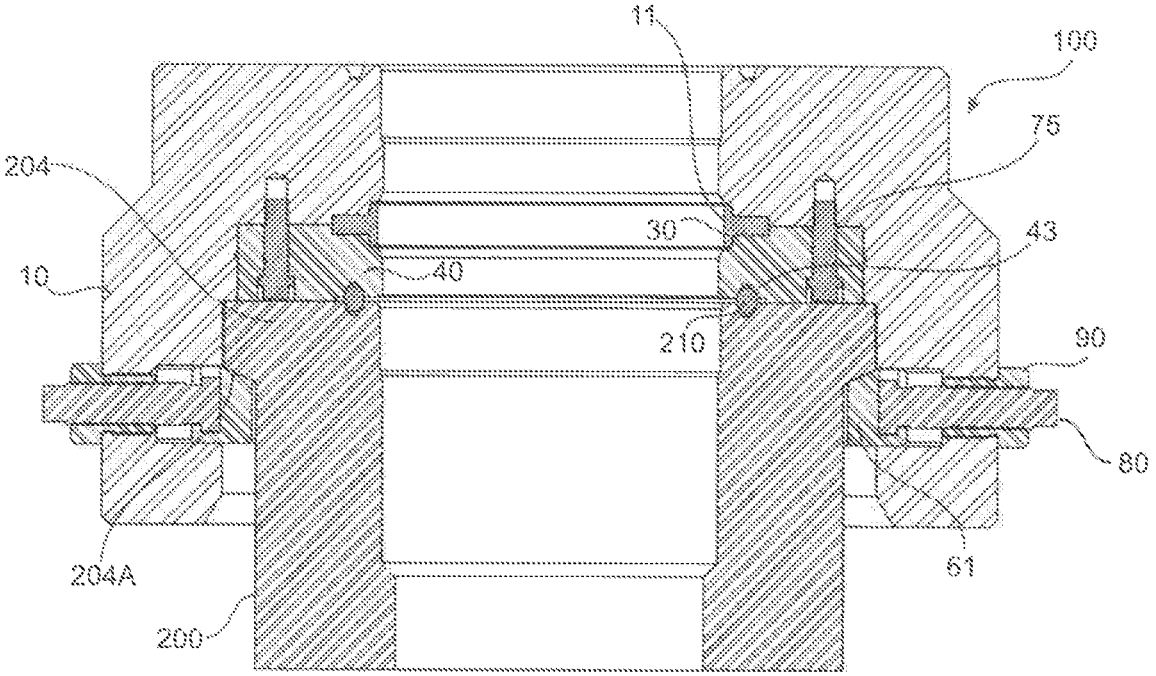
FIG. 11 depicts a side sectional view of a wellhead connector assembly of the present invention installed on a wellhead hub.

FIG. 10 depicts a side perspective and sectional view of a wellhead connector assembly 100 of the present invention installed on a conventional wellhead hub 200, while FIG. 11 depicts a side sectional view of said wellhead connector assembly 100 of the present invention installed on said conventional wellhead hub 200. Referring to FIG. 11, wellhead connector body 10 contains an internal seal groove 11 to accept (typically metallic) first seal member 30, and replaceable seal member 40 is secured in place with a plurality of threaded fasteners 75. Wellhead connector assembly 100 accepts wellhead hub 200 and the wellhead seal ring 210 into the internal cavity of said wellhead connector assembly 100 until seal groove 43 of replaceable seal member 40 contacts and cooperates with wellhead seal ring 210 to form a fluid pressure seal between wellhead connector assembly 100 and wellhead hub 200.

In operation, still referring to FIG. 11, first seal member 30 (which is typically constructed at least in part from metal) is compressed between the connector body 10 internal seal groove 11 and replaceable seal member seal groove 42 of seal member 40. First seal member 30 is energized to form a fluid pressure seal (and contain internal fluid pressure) between connector body 10 and internal replaceable seal member 40 using the plurality threaded fasteners 75, particularly with seal surfaces 33. A fluid pressure seal is created by applying torque to the plurality of threaded fasteners 75 when securing replaceable seal member 40 in place.

The connector body 10 accepts a plurality of moveable clamp wedge segments 61, manual actuating screws 80 and actuating screw gland nuts 90. Said plurality of actuation screws 80 can selectively move said clamp wedge segments 61 from an unlocked to a locked position by moving said clamp wedge segments 61 radially inward to engage with the angled shoulder surface 204A of wellhead clamp hub 204. Put another way, a predetermined amount of torque can be applied to each of the plurality of actuation screws 80 and clamp segments 61 to force said radial clamp segments 61 radially inward to engage with wellhead clamp hub 204 and shoulder surface 204A of wellhead 200. Further, said clamp segments 61 provide sufficient radial and axial force to wellhead 200 and wellhead clamp hub 204 to secure said wellhead connector assembly 100 to wellhead 200. Said clamp segments 61 also provide sufficient axial force to energize wellhead seal ring 210 in to provide a fluid pressure seal between said wellhead connector assembly 100 and wellhead 200

During installation or re-use of wellhead connector assembly 100, wellhead seal groove 43 of seal member 40 may become damaged; such damage can occur from a variety of different causes, such as inadvertent or accidental contact with other components, damage during shipping or storage, or other causes. Such damage can render wellhead connector assembly 10 unusable (and particularly wellhead seal groove 43) and in need of repair. For example, damage to wellhead seal groove 43 (such as gouges or ruts) can prevent seal groove 43 from making consistent and substantially uninterrupted contact with seal wellhead seal ring 210 in order to form a fluid pressure seal.

However, because replaceable seal member 40 is a removable component, a low cost repair can be made in the field (such as at a wellsite) by quickly, safely and efficiently removing said seal member 40 from wellhead connector assembly 100. A new replaceable seal member 40 can be quickly and efficiently installed in wellhead connector assembly 100 at a wellsite with minimal down time to ongoing operations (typically drilling operations). Unlike conventional solutions, wellhead connection assembly 100 need not be transported to a distant machine shop or other facility for expensive and time-consuming repairs. Fast and cost-effective repair of connector assembly 100 (and, more specifically, seal groove 43 which must form a fluid pressure seal with seal ring 210) by replacing said removable seal member 40 in the field also decreases labor requirements, as well as associated risk and expense.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A wellhead connector assembly for operational attachment of a separate component to a wellhead hub comprising:

a) a body member having a central through bore and an interface for attaching a separate component;

b) a replaceable seal member disposed within said central through bore of said body member, wherein said replaceable seal member is configured to form a fluid pressure seal against said wellhead hub; and c) a fastening assembly for selectively securing said body member to said wellhead hub, wherein at least a portion of said wellhead hub is received in said central through bore of said body member and said fastening assembly is configured to grip said wellhead hub; and d) a secondary seal member disposed between said replaceable seal member and said body member.

2. The wellhead connector assembly of claim 1, wherein said replaceable seal member is secured to said body member using at least one mechanical fastener.

3. The wellhead connector assembly of claim 1, wherein said replaceable seal member is configured to be selectively exchanged with a different replaceable seal member at a wellsite.

4. The wellhead connector assembly of claim 1, wherein said replaceable seal member is at least partially constructed of rubber or elastomer material.

5. The wellhead connector assembly of claim 1, wherein said separate component comprises a blowout preventer assembly or Christmas tree.

6. A wellhead connector assembly for operational attachment of a separate component to a wellhead hub comprising:

a) a body member having a central through bore and an interface for attaching a separate component;

b) a replaceable seal member disposed within said central bore of said body member, wherein said replaceable seal member is configured to form a fluid pressure seal against said wellhead hub;

c) a fastening assembly for selectively securing said body member to said wellhead hub, wherein at least a portion of said wellhead hub is received in said central through bore of said body member and said fastening assembly is configured to apply radially inward force to said wellhead hub; and d) a secondary seal member disposed between said replaceable seal member and said body member.

7. The wellhead connector assembly of claim 6, wherein said replaceable seal member is secured to said body member using at least one mechanical fastener.

8. The wellhead connector assembly of claim 6, wherein said replaceable seal member is configured to be selectively exchanged with a different replaceable seal member at a wellsite.

9. The wellhead connector assembly of claim 6, wherein said replaceable seal member is at least partially constructed of rubber or elastomer material.

10. The wellhead connector assembly of claim 6, wherein said separate component comprises a blowout preventer assembly or Christmas tree.

11. A method of attaching a component to a wellhead hub comprising:

a) providing a wellhead connector assembly comprising:

i) a body member having a central through bore and an interface for attaching a separate component;

ii) a replaceable seal member disposed within said central bore of said body member, wherein said replaceable seal member is configured to form a fluid pressure seal said wellhead hub;

iii) a secondary seal member disposed between said replaceable seal member and said body member;

b) installing said body member on said wellhead hub, wherein at least a portion of said wellhead hub is received in said central through bore of said body member;

c) fastening said body member to said wellhead hub; and d) attaching said separate component to said interface of said body member.

12. The method of claim 11, wherein said replaceable seal member is secured to said body member using at least one mechanical fastener.

13. The method of claim 11, wherein said replaceable seal member is at least partially constructed of rubber or elastomer material.

14. The method of claim 11, wherein said component attached to said wellhead connector assembly comprises a blowout preventer assembly or Christmas tree.

15. The method of claim 11, further comprising:

a) removing said body member of said wellhead connector assembly from said wellhead hub;

b) exchanging said replaceable seal member with a different replaceable seal member; and c) fastening said body member of said wellhead connector assembly to said wellhead hub.

16. The method of claim 15, wherein said step of exchanging said replaceable seal member with a different replaceable seal member is performed at a wellsite.

* * * * *